US005996604A

United States Patent [19]

Doelle et al.

[11] Patent Number: 5,996,604

[45] Date of Patent: Dec. 7, 1999

[54] APPARATUS AND METHOD FOR PROVIDING PROCESS WATER USED FOR MAKING OR PROCESSING A FIBER SUSPENSION

[75] Inventors: Klaus Doelle; Kurt William Lorenz, both of Appleton; Oliver U. Heise, Menasha; Werner Witek; Robert J. Matz, both of Appleton, all of Wis.

[73] Assignee: Voith Sulzer Paper Technology North America, Inc., Appleton, Wis.

[21] Appl. No.: 09/140,231

[22] Filed: Aug. 26, 1998

[51] Int. Cl.[6] ..... E03B 11/00

[52] U.S. Cl. ..... 137/1; 137/92; 137/575; 137/576; 210/197; 210/255; 210/521; 210/801; 210/805

[58] Field of Search ..... 137/571, 572, 137/575, 576, 92.1; 210/801, 803, 805, 255, 197, 521, 522

[56] References Cited

U.S. PATENT DOCUMENTS

| | | | |
|---|---|---|---|
| 1,451,659 | 4/1923 | Hockman | 137/576 X |
| 1,619,682 | 3/1927 | Sheridan | 137/576 X |
| 2,703,607 | 3/1955 | Simmonds | 137/575 X |
| 2,714,341 | 8/1955 | Poirier | 137/92 |
| 3,772,190 | 11/1973 | Eisenmann | 210/255 X |
| 4,048,070 | 9/1977 | Propp | 210/522 X |
| 4,362,628 | 12/1982 | Kennedy et al. | 210/805 X |
| 5,599,426 | 2/1997 | Hoffman | 162/60 |

FOREIGN PATENT DOCUMENTS

| | | | |
|---|---|---|---|
| 479972 | 5/1916 | France | 210/255 |
| 28159 | 3/1977 | Japan | 210/255 |

*Primary Examiner*—David J. Walczak
*Assistant Examiner*—Kathleen J. Prunner
*Attorney, Agent, or Firm*—Taylor & Associates, P.C.

[57] ABSTRACT

An apparatus providing process water used for making or processing a fiber suspension includes a multi-compartment tank with a top, a bottom wall, and a plurality of exterior sidewalls. Each compartment has an inlet positioned near the top, an outlet positioned near the bottom wall, and at least one intervening wall common with an adjacent compartment. Each intervening wall has a height defining an overflow weir whereby the compartments are arranged with sequentially decreasing maximum fluid levels. Each intervening wall also has a backflow device positioned near the bottom wall. The backflow device is selectively openable to allow flow from one compartment to an adjacent compartment in a direction opposite to a flow direction over the corresponding overflow weir.

12 Claims, 1 Drawing Sheet

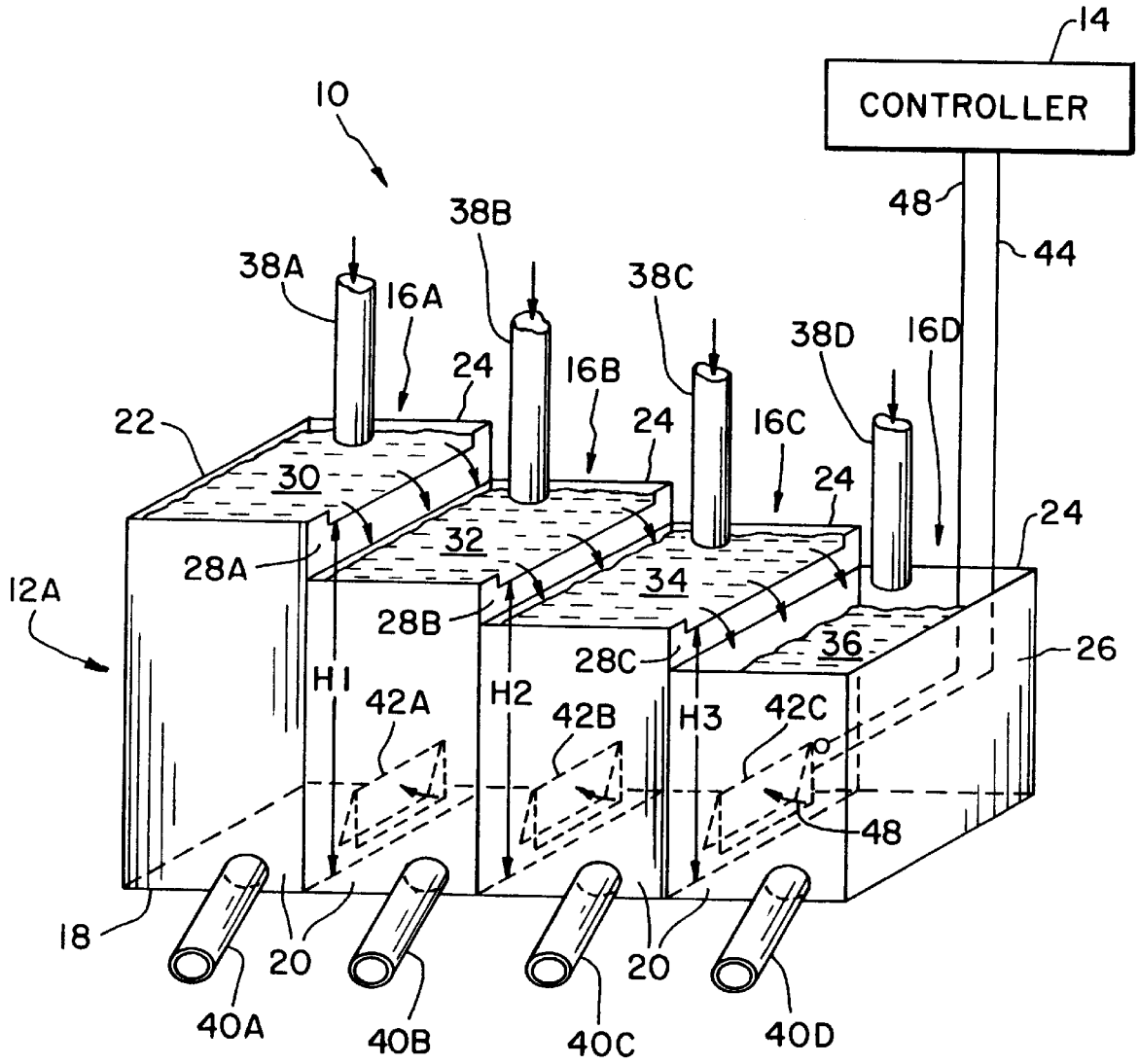
14
CONTROLLER
10
48
44
38B
38A
16A
38C
38D
16D
24
16B
22
24
16C
30
24
24
32
28A
34
12A
28B
36
26
28C
H1
H2
H3
42A
42B
42C
48
18
20
20
40A
40B
40C
40D

APPARATUS AND METHOD FOR PROVIDING PROCESS WATER USED FOR MAKING OR PROCESSING A FIBER SUSPENSION

BACKGROUND OF THE INVENTION

1. Field of the Invention

The present invention relates to an apparatus and method for making or processing a fiber suspension used in a paper-making machine, and, more particularly, to an apparatus providing process water used for making or processing the fiber suspension.

2. Description of the Related Art

A paper-making machine typically receives a fiber suspension, such as a wood fiber suspension, at the wet end thereof. The fiber suspension is discharged with a known cross-sectional profile across the width of the machine onto a forming fabric. The fiber suspension is drained, pressed and dried to ultimately form a paper web as an end product. Typically, the fiber suspension is treated in a plurality of steps known as "stock preparation" so that a fiber suspension with known physical properties may be supplied to the wet end of the machine. One such treating process involves the use of a "pulp washer" which washes the fiber suspension using a plurality of showers which extend across the width of the fiber suspension. The showers utilize one or more different grades of process water and fresh water. The process water may be segregated into different grades having different respective contamination levels. Different grades of process water may be suitably used for different parts of the pulp washing operation. Since a pulp washer utilizes the plurality of showers at different locations therein to effect the pulp washing process, it is of course necessary to ensure that an adequate supply of process water is available.

What is needed in the art is an apparatus for supplying an adequate amount of process water with a contamination level at or below a predetermined level.

SUMMARY OF THE INVENTION

The present invention provides a multi-compartment tank with adjacent compartments separated by a common intervening wall which defines an overflow weir allowing flow in one flow direction and which includes a shut-off door allowing selective flow in an opposite direction. The overflow weirs are configured with sequentially decreasing heights, whereby the compartments are arranged with sequentially decreasing maximum fluid levels.

The invention comprises, in one form thereof, an apparatus providing process water used for making or processing a fiber suspension. A multi-compartment tank has a top, a bottom wall, and a plurality of exterior sidewalls. Each compartment has an inlet positioned near the top, an outlet positioned near the bottom wall, and at least one intervening wall common with an adjacent compartment. Each intervening wall has a height defining an overflow weir whereby the compartments are arranged with sequentially decreasing maximum fluid levels. Each intervening wall also has a backflow device positioned near the bottom wall. The backflow device is selectively openable to allow flow from one compartment to an adjacent compartment in a direction opposite to a flow direction over the corresponding overflow weir.

An advantage of the present invention is that process water with different contamination levels can be provided for making or processing the fiber suspension.

Another advantage is that overflow water from one compartment always flows to an adjacent compartment having process water with a higher contamination level, and not vice-versa.

Yet another advantage is that the shut-off door between adjacent compartments can be opened to provide make-up process water if the fluid level in the upstream compartment becomes too low.

A further advantage is that the shut-off door can be opened and closed dependent upon a pressure differential between adjacent compartments or automatically using a controller.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, which is a schematic perspective view of one embodiment of the apparatus of the present invention. The exemplification set out herein illustrates one preferred embodiment of the invention, in one form, and such exemplification is not to be construed as limiting the scope of the invention in any manner.

DETAILED DESCRIPTION OF THE INVENTION

Referring now to the drawing, there is shown an apparatus 10 for providing process water which is used for making or processing a fiber suspension for use in a paper-making machine. Apparatus 10, in the embodiment shown, generally includes a multi-compartment tank 12A and a controller 14.

Multi-compartment tank 12A includes an open top 16A, 16B, 16C and 16D, a bottom wall 18 and a plurality of exterior side walls 20, 22, 24, and 26. Side walls 20, 22, 24 and 26, together with a plurality of intervening walls 28A, 28B, and 28C, define four compartments 30, 32, 34 and 36. Each compartment 30, 32, 34 and 36 contains a respective grade of process liquid or process water which is used in a stock preparation and/or paper-making process. More particularly, compartment 30 contains the highest grade of process water (i.e., the least amount of contaminants), compartment 32 contains a lower grade process water, compartment 34 contains yet a lower grade of process water, and compartment 36 contains the lowest grade of process water.

Intervening walls 28A, 28B, and 28C are common between two adjacent compartments. More particularly, intervening wall 28A is common between compartments 30 and 32; intervening wall 28B is common between compartments 32 and 34; and intervening wall 28C is common between compartments 34 and 36. Each intervening wall 28A, 28B and 28C has a respective height H1, H2 and H3 which define corresponding overflow weirs between compartments 30, 32, 34 and 36. Heights H1, H2, and H3 and the correspondingly defined overflow weirs successively decrease in progression across tanks 30, 32, 34 and 36. Since the maximum fluid level of the process water within tanks 30, 32 and 34 is respectively defined by heights H1, H2 and H3, the maximum fluid level within compartments 30, 32, 34 and 36 likewise decreases with decreasing heights H1, H2 and H3.

Each compartment 30, 32, 34 and 36 includes respective inlets 38A, 38B, 38C and 38D through which a corresponding grade of process water is transported into compartments 30, 32, 34 and 36. Each inlet 38A, 38B, 38C and 38D receives process water from a corresponding portion of an additional apparatus for processing the fiber suspension, such as a pulp washer or thickener. Inlets 38A, 38B, 38C and 38D provide sequentially decreasing grades of process water. For example, inlet 38A may receive process water from a downstream portion of a pulp washer, while inlet 38D may receive process water from an upstream portion of a pulp washer (or vice versa). In the embodiment shown, each inlet 38A, 38B, 38C and 38D is in the form of a pipe which is open at the bottom end thereof, and which discharges the corresponding process water directly into an associated compartment 30, 32, 34 and 36. However, inlets 38A, 38B, 38C and 38D may also be directly connected to a top wall (not shown) of compartments 30, 32, 34 and 36; or may be connected near a top of a side wall 20 or 24.

Each compartment 30, 32, 34 and 36 also includes a respective outlet 40A, 40B, 40C and 40D which is connected with side wall 20 near bottom wall 18. It will be appreciated, however, that outlets 40A, 40B, 40C and 40D may be connected at any desirable location at or near bottom wall 18 (such as directly connected to bottom wall 18), to thereby convey process water away from compartments 30, 32, 34 and 36. In the embodiment shown, cleaner process liquid from outlet pipe 40A is transported to an upstream end of a pulp washer, and process water from outlet pipes 40B and 40C is respectively transported to successive downstream portions of the pulp washer. Process liquid from outlet pipe 40D is transported to a filtering system for filtering out contaminants therein. Thereafter, the filtered process water may be transported to and used in the pulp washer.

Each intervening wall 28A, 28B and 28C also includes a backflow device in the form of a shut-off door 42A, 42B and 42C, respectively, which is positioned near bottom wall 18. Each shut-off door 42A, 42B and 42C is pivotally connected at the top thereof to the respective intervening wall 28A, 28B and 28C via a hinge, and is selectively openable and closable to allow flow from one compartment to an upstream, adjacent compartment in a flow direction which is opposite to the flow direction over the associated overflow weir. More particularly, each shut-off door 42A, 42B and 42C may be selectively opened or closed using a suitable device employing electrical, mechanical and/or fluid power. The power device in turn is connected via an electrical conductor 44 with controller 14. Controller 14 is also connected with and receives input signals from a plurality of sensors respectively associated with intervening walls 28A, 28B and 28C, one of which is shown carried by intervening wall 28C and referenced 46. Sensor 46 senses a fluid level of the process water within compartment 34. If the fluid level of the process liquid within compartment 34 reaches a predetermined minimum level associated with the attachment height of sensor 46, an output signal is provided to controller 14 over electrical conductor 48, indicating that make-up water within compartment 34 is required. Controller 14 then opens shut-off door 42C by pivotally swinging shut-off door 42C into compartment 34, as indicated by directional arrow 48. Process water within compartment 36 is at a fluid level which is higher than the low water level sensed within compartment 34. Accordingly, the pressure head differential between compartments 34 and 36 causes process water to flow from compartment 36 into compartment 34. Thus, in the event that process water is used from within compartment 34 at a rate faster than process water flows over the overflow weir defined by intervening wall 28B (or if no process water is flowing over the overflow weir defined by intervening wall 28B), then make-up process water can be obtained from compartment 36 by selectively opening shut-off door 42C. Shutoff doors 42A and 42B are also similarly controlled using controller 14.

Although a controller 14 is shown in the drawing for the purpose of selectively opening and closing shut-off doors 42A, 42B and 42C, it is also possible to use only the pressure differentials between adjacent compartments to open and close a corresponding shut-off door 42A, 42B and 42C. For example, shut-off door 42B may be configured to be biased open by the pressure differential between the process liquids in compartments 32 and 34 if the fluid height of a process liquid within compartment 34 is above the fluid height of the processed liquid within compartment 32 by a predetermined amount. Alternatively, shut-off doors 42A, 42B and 42C may be replaced with other suitable structure such as pressure actuated valves which open and close at different pressure differentials on the inlet and outlet sides thereof.

Multi-compartment tank 12A of the present invention allows process water of different grades to be segregated and used for different applications, or in different parts of a same application. If process water in one compartment is used more than process water in an immediately adjacent upstream compartment, the overflow weir defined by the intervening wall therebetween allows process water from the adjacent upstream compartment to flow into the downstream compartment where the process water is being more rapidly used. In this manner, only process water with a higher grade (i.e., lower contamination) may be mixed with process water in an adjacent compartment. The grade of the process water within the compartment to which the make-up water is added therefore does not decrease below an assumed contamination level. Process water with a higher contamination level is only added as make-up water if the liquid level within a particular compartment reaches a minimum threshold value which is sensed by a sensor. In the event the process water level reaches the minimum threshold level, the desired requirement for maintaining the contaminants at or below a predetermined level is overcome by the necessity to add make-up water into the compartment so that a constant output may be provided through outlets 40A–40D.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus providing process water used for making or processing a fiber suspension, said apparatus comprising:

a multi-compartment tank having a top, a bottom wall, and a plurality of exterior sidewalls, each said compartment having an inlet positioned near said top, an outlet positioned near said bottom wall, and at least one intervening wall common with an adjacent said compartment, each said intervening wall having a height defining an overflow weir which is one of fixed and adjustable, whereby said compartments are arranged with sequentially decreasing maximum fluid levels, each said intervening wall also having a backflow device positioned near said bottom wall, said backflow device being selectively openable to allow flow from one said compartment to an adjacent said compartment in a direction opposite to a flow direction over said corresponding overflow weir.

2. The apparatus of claim 1, wherein said multi-compartment tank includes four compartments and three intervening walls.

3. The apparatus of claim 1, wherein each said backflow device comprises a shut-off door which is pivotally connected to said associated intervening wall.

4. The apparatus of claim 3, wherein each said shut-off door is pivotally opened and closed dependent upon a fluid height differential between said adjacent compartments associated with said intervening wall.

5. The apparatus of claim 3, wherein each said shut-off door is selectively controllably opened and closed.

6. The apparatus of claim 1, wherein each said inlet comprises an inlet pipe and each said outlet comprises an outlet pipe.

7. The apparatus of claim 1, wherein said top comprises an open top.

8. A method of providing process water used for making or processing a fiber suspension, said method comprising the steps of:

providing a multi-compartment tank having a top, a bottom wall, and a plurality of exterior sidewalls, each said compartment having an inlet positioned near said top, an outlet positioned near said bottom wall, and at least one intervening wall common with an adjacent said compartment, each said intervening wall having a height defining an overflow weir which is one of fixed and adjustable, whereby said compartments are arranged with sequentially decreasing maximum fluid levels, each said intervening wall also having a backflow device positioned near said bottom wall;

flowing process water from one said compartment over said corresponding overflow weir at said maximum fluid level into an adjacent said compartment; and opening said backflow device in said one intervening wall to allow flow from said adjacent compartment to said one compartment in a direction opposite to said flow over said corresponding overflow weir.

9. The method of claim 8, wherein each said backflow device comprises a shut-off door which is pivotally connected to said associated intervening wall, and wherein said opening step comprises pivoting said shut-off door to said open position.

10. The method of claim 9, wherein said opening step is dependent upon a fluid height differential between said adjacent compartments associated with said intervening wall.

11. The method of claim 10, wherein said shut-off door opens when a fluid height in said one compartment is less than a fluid height in said adjacent compartment by a predetermined height differential.

12. The method of claim 9, wherein said shut-off door is selectively controllably opened and closed.

* * * * *